US011225723B2

(12) United States Patent
Le et al.

(10) Patent No.: US 11,225,723 B2
(45) Date of Patent: Jan. 18, 2022

(54) SYSTEM AND METHOD FOR MAKING HYPOCHLOROUS ACID USING SALTWATER WITH SODIUM BICARBONATE

(71) Applicants: Hien Tu Le, Happy Valley, OR (US); Gia Thanh Le, Happy Valley, OR (US); Joseph Tu Le, Happy Valley, OR (US)

(72) Inventors: Hien Tu Le, Happy Valley, OR (US); Gia Thanh Le, Happy Valley, OR (US); Joseph Tu Le, Happy Valley, OR (US)

( * ) Notice: Subject to any disclaimer, the term of this patent is extended or adjusted under 35 U.S.C. 154(b) by 0 days.

(21) Appl. No.: 17/217,958

(22) Filed: Mar. 30, 2021

(65) Prior Publication Data

US 2021/0395904 A1 Dec. 23, 2021

Related U.S. Application Data

(60) Provisional application No. 63/041,626, filed on Jun. 19, 2020, provisional application No. 63/054,708, filed on Jul. 21, 2020.

(51) Int. Cl.

| | |
|---|---|
| ***C25B 1/50*** | (2021.01) |
| ***C25B 15/08*** | (2006.01) |
| ***C25B 1/26*** | (2006.01) |

(52) U.S. Cl.

CPC ..... *C25B 1/50* (2021.01); *C25B 1/26* (2013.01); *C25B 15/083* (2021.01)

(58) Field of Classification Search

CPC ..... C25B 1/26

USPC ..... 205/500

See application file for complete search history.

(56) References Cited

U.S. PATENT DOCUMENTS

| | | | | |
|---|---|---|---|---|
| 3,390,065 | A * | 6/1968 | Cooper | C25B 9/17 205/412 |
| 4,190,638 | A | 2/1980 | Hoekje et al. | |
| 4,240,884 | A * | 12/1980 | Pellegri | C25B 1/26 205/500 |
| 6,719,891 | B2 * | 4/2004 | Ruhr | A61L 2/035 205/500 |

(Continued)

FOREIGN PATENT DOCUMENTS

| | | | |
|---|---|---|---|
| EP | 3312305 | A1 | 4/2018 |
| WO | WO2004098657 | A1 | 11/2004 |
| WO | WO2012041357 | A1 | 4/2012 |

*Primary Examiner* — Harry D Wilkins, III

(57) ABSTRACT

A system and a method are provided for making hypochlorous acid using saltwater with sodium bicarbonate. The system includes an electrolytic cell, a quantity of saltwater solution, and a quantity of sodium bicarbonate. The quantity of saltwater solution is poured into the electrolytic cell and then undergoes an electrolytic process. As a result of the quantity of saltwater solution going through the electrolytic process, a hypochlorous acid solution is yielded. In order to ensure a pure hypochlorous acid solution is formed, the quantity of sodium bicarbonate can be added into the electrolytic cell along with the quantity of saltwater solution before the electrolytic process or the quantity of sodium bicarbonate can be added into the hypochlorous acid solution after the hypochlorous acid solution is yielded. This process adjusts the pH level of the hypochlorous acid solution, and thus, produces a purer hypochlorous acid solution.

10 Claims, 10 Drawing Sheets

(56) References Cited

U.S. PATENT DOCUMENTS

| | | | | |
|---|---|---|---|---|
| 2006/0054510 | A1* | 3/2006 | Salerno | C25B 15/02 205/335 |
| 2008/0264778 | A1* | 10/2008 | Joshi | C25B 1/26 204/232 |
| 2010/0078331 | A1* | 4/2010 | Scherson | C25B 1/26 205/335 |
| 2012/0269904 | A1 | 10/2012 | Northey | |
| 2012/0291800 | A1* | 11/2012 | Johnson | C23F 11/173 134/3 |
| 2016/0044926 | A1* | 2/2016 | Peters | A01N 59/00 205/335 |
| 2017/0202877 | A1* | 7/2017 | Hoover | A61L 26/0066 |

* cited by examiner

SYSTEM AND METHOD FOR MAKING HYPOCHLOROUS ACID USING SALTWATER WITH SODIUM BICARBONATE

The current application claims a priority to the U.S. Provisional Patent application Ser. No. 63/041,626 filed on Jun. 19, 2020 and a priority to the U.S. Provisional Patent application Ser. No. 63/054,708 filed on Jul. 21, 2020.

FIELD OF THE INVENTION

The present invention relates generally to methods of making Hypochlorous Acid (HOCl) by electrolyzing saltwater. More specifically, the present invention is a method for making hypochlorous acid using saltwater with sodium bicarbonate. In more detail, sodium bicarbonate is added to adjust the pH level for the final solution.

BACKGROUND OF THE INVENTION

Hypochlorous acid (HOCl) has been proven to be a safe and effective disinfectant, acknowledged by both the FDA (Food and Drug Administration) and the EPA (Environmental Protection Agency) as "GRAS" (Generally Recognized as Safe).

Making hypochlorous acid by the method of electrolysis which involves applying electrical current to the salt water (usually NaCl or KCl). This process would separate the dissociated salt ions, $Na^+$, or $K^+$, and $Cl^-$, further towards the electrical terminals. $Cl^-$ ions would be attracted to the anode (positive terminal); while the positive ions ($Na^+$ or $K^+$) would be attracted to the cathode (negative terminal). At the anode $Cl^-$ ions combine with water ($H_2O$) to form the following (for convenience, the following equations will make use of $Na^+$ but can be substituted with $K^+$ and its byproducts):

$$2Cl^- + H_2O \rightarrow HOCl \text{ (hypochlorous acid)} + HCl \text{ (hydrochloric acid)}$$

At the cathode, $Na^+$ combines with water ($H_2O$) to form the following:

$$2Na^+ + 2H_2O \rightarrow 2NaOH \text{ (sodium hydroxide)} + H_2$$

There are two popular methods of making hypochlorous acid by electrolysis. The first method would just apply electrical current to create the above 2 equations in one container. This would form a mixture of HOCl, NaOCl, NaOH, HCl. This is not pure HOCl and it contains unhealthy chemicals such as NaOCl, NaOH, and HCl.

The second popular method would use a semipermeable/ionic membrane to separate the output solutions into two separate containers. First solution would be $NaOH_{(aq)}$ and the second solution would be HOCl+HCl. The higher the concentration of the second solution gets, the lower its pH level is. This is due to the presence of HCl. This also means the lower the pH is, the less safe it would become.

The present invention would add sodium bicarbonate ($NaHCO_3$) into the saltwater solution using the method that utilizes the semipermeable/ionic membrane. This would yield the following:

$$HCO_3^- + Cl_2^- + 2H_2O \rightarrow 2HOCl + H_2CO_3 \leftrightarrows HOCl + H_2O + CO_2 \text{ (at anode chamber)}$$

$$2Na^+ + 2H_2O \rightarrow 2NaOH + H_2 \text{ (at cathode chamber)}$$

For this process, HOCl and $H_2CO_3$ (carbonic acid) are formed at the anode chamber. Carbonic acid itself is a very weak acid, that is formed naturally in human body, which is essential to the gas exchange process. Even that, the carbonic acid would break down further into $H_2O$ (aq) and $CO_2$(g). The resulting solution would have higher pH due to the absence of the strong hydrochloric acid (HCl). Therefore, this process yields much purer hypochlorous acid solution.

DETAIL DESCRIPTIONS OF THE INVENTION

All illustrations of the drawings are for the purpose of describing selected versions of the present invention and are not intended to limit the scope of the present invention.

Figure 1:
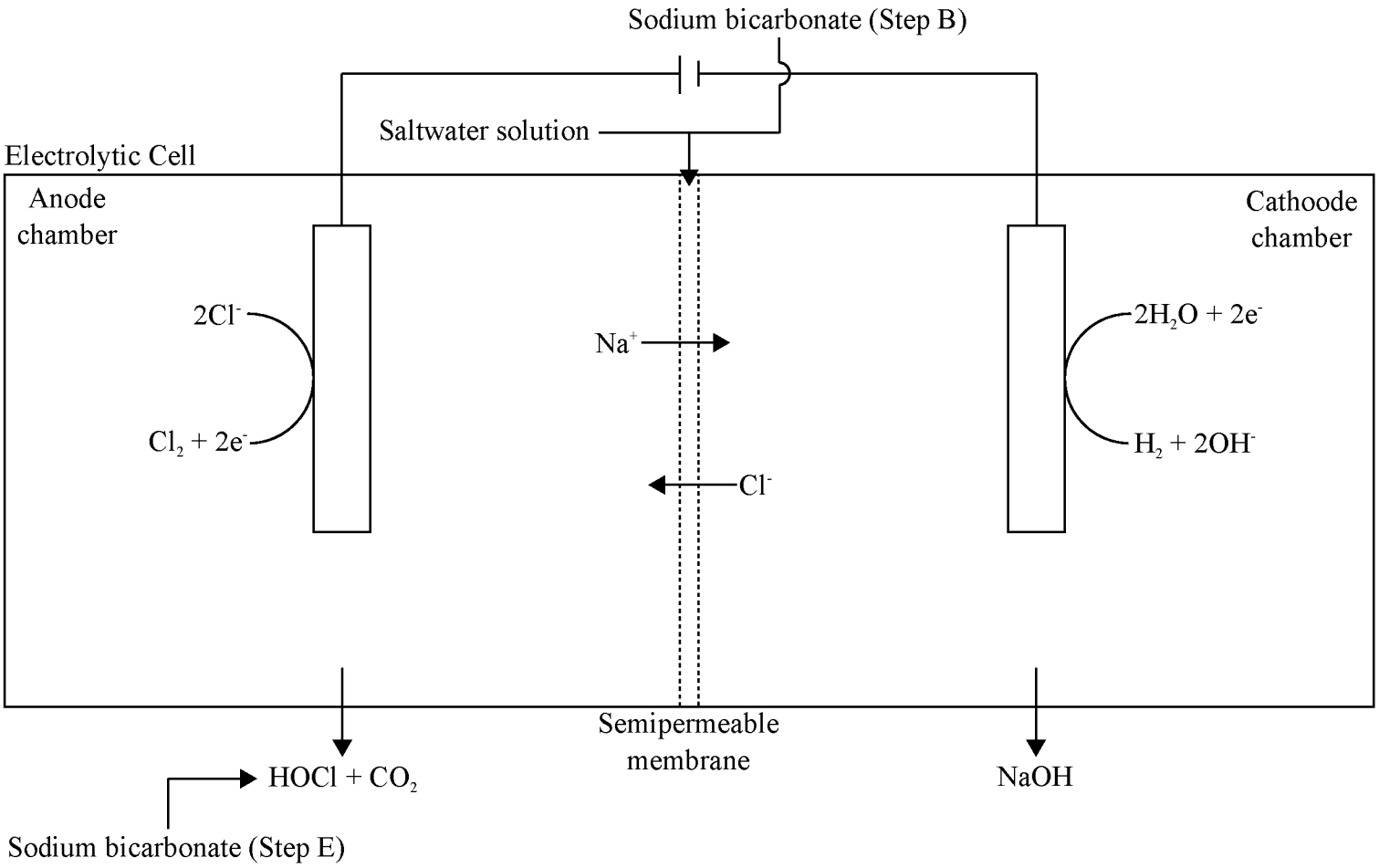
FIG. 1 is a system diagram of the present invention.

In reference to FIGS. 1 through 10, the present invention is a system and method for making hypochlorous acid using saltwater with sodium bicarbonate. With reference to FIG. 1, the system of the present invention includes an electrolytic cell, a quantity of saltwater solution, and a quantity of sodium bicarbonate (Step A). The electrolytic cell is an electrochemical device used to decompose compounds. The electrolytic cell includes at least one solution inlet, a waste outlet, a yield outlet, a cathode chamber, an anode chamber, and a semipermeable membrane. The solution inlet is in fluid communication with both the cathode chamber and the anode chamber. The anode chamber and the cathode chamber are in osmotic communication with each other through the semipermeable membrane, the anode chamber is in fluid communication with the yield outlet, and the cathode chamber is in fluid communication with the waste outlet. The quantity of saltwater solution may be any type of saltwater solution such as, but not limited, a sodium chloride (NaCl) solution, a potassium chloride (KCl) solution, or a sodium hypochlorite (NaOCl) solution. The quantity of sodium bicarbonate is preferably the compound $NaHCO_3$ or baking soda.

Figure 2:
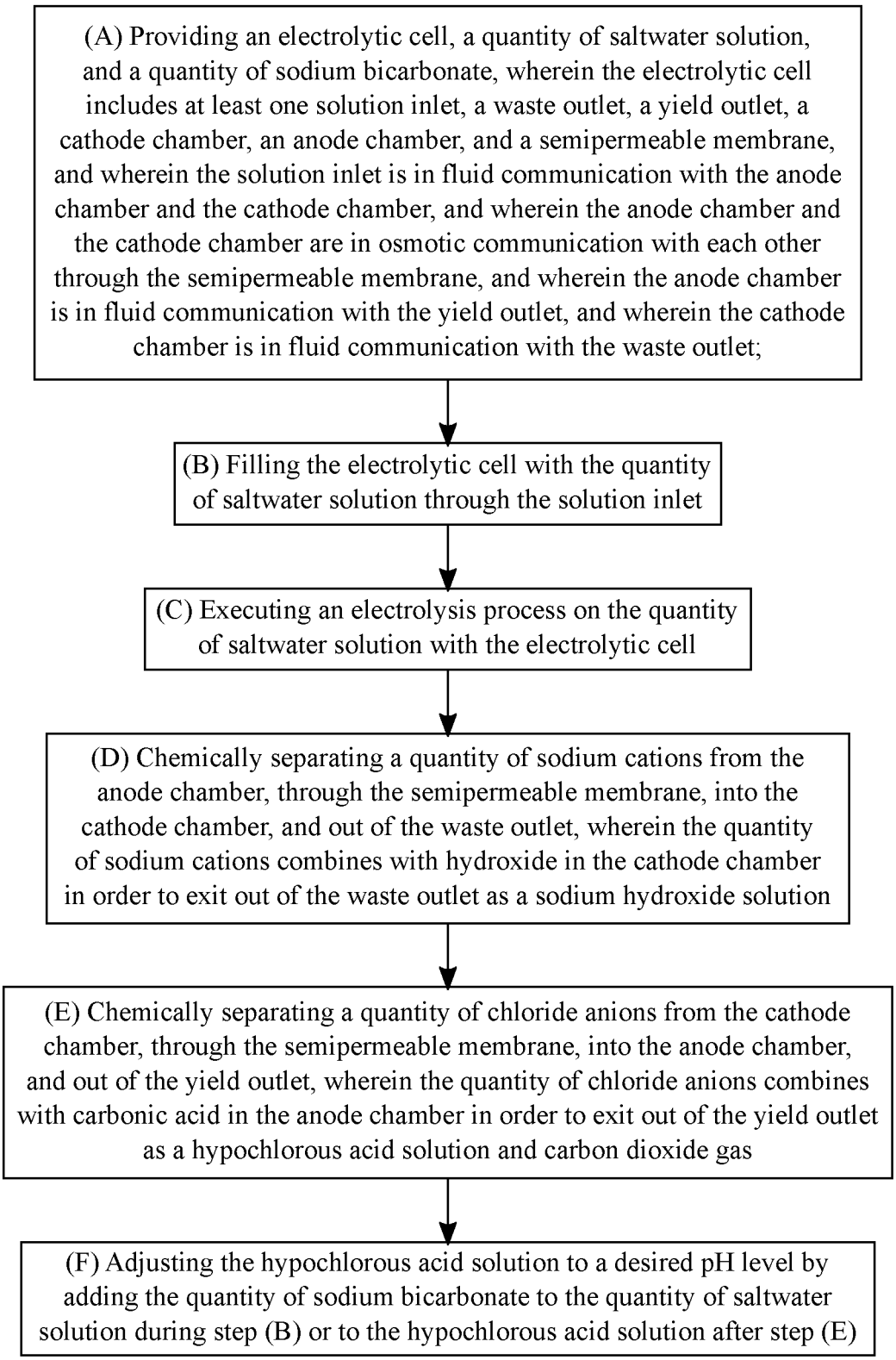
FIG. 2 is a flowchart illustrating the overall process for the method of the present invention.

With reference to FIG. 2, the method of the present invention follows an overall process for making hypochlorous acid using saltwater with sodium bicarbonate. First, the electrolytic cell is filled with the quantity of saltwater solution through the solution inlet (Step B). In further detail, Step B prepares the quantity of saltwater solution for electrolysis. Additionally, Step B can be executed through various methods. The electrolysis process is then executed on the quantity of saltwater solution with the electrolytic cell (Step C). In further detail, Step C applies a direct electric current to the quantity of saltwater solution in order to produce chemical reactions. During the electrolysis process, a quantity of sodium cations is chemically separated from the anode chamber, through the semipermeable membrane, into the cathode chamber, and out of the waste outlet (Step D). As a result of the electrolysis process, the quantity of sodium cations combines with hydroxide in the cathode chamber in order to exit out of the waste outlet as a sodium hydroxide solution. Thus, the sodium hydroxide solution is separated from the desired compound of the electrolysis process. Also during the electrolysis process, a quantity of chloride anions is chemically separated from the cathode chamber, through the semipermeable membrane, and out of the yield outlet (Step E). As a result of the electrolysis process, the quantity of chloride anions combines with carbonic acid in the anode chamber in order to exit out of the yield outlet as a hypochlorous acid solution and carbon dioxide gas. Thus, the hypochlorous acid solution is compounded as a result of the saltwater being electrolyzed. The formation of the hypochlorous acid solution in the yield solution depends on the pH level of the solution. Hypochlorous acid formation is optimal at a pH level between 4.5 to 5.5. The presence of sodium bicarbonate prevents hydrochloric acid from being formed with the hypochlorous acid solution, and therefore increases the pH level of the yield solution. In order to output a purer hypochlorous acid solution, the hypochlorous acid solution is adjusted to a desired pH level by adding the quantity of sodium bicarbonate to the quantity of saltwater solution during Step B or Step E (Step F). In further detail, the quantity of sodium bicarbonate can be poured into the electrolytic cell with the quantity of saltwater solution in Step B or the quantity of sodium bicarbonate can be poured into the hypochlorous acid solution after Step E.

Figure 3:
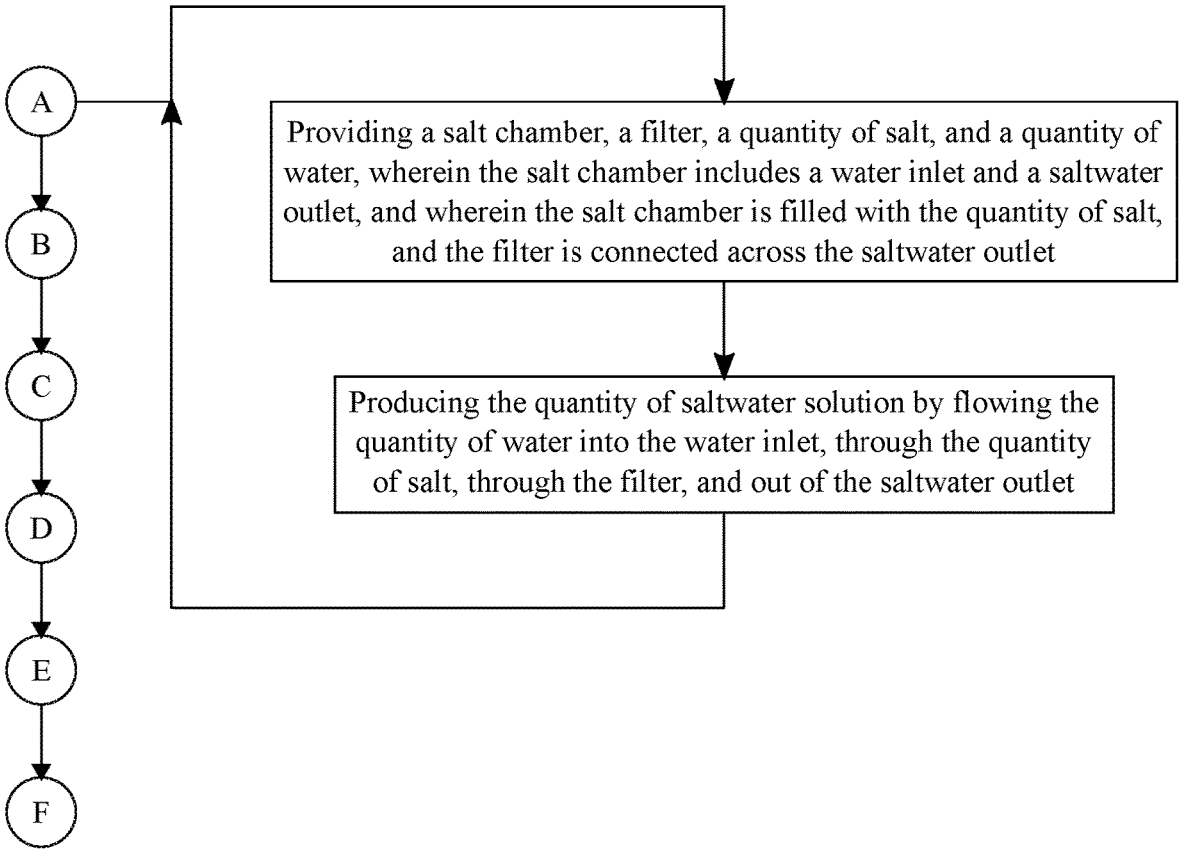
FIG. 3 is a flowchart illustrating the subprocess for producing the quantity of saltwater solution.
Figure 4:
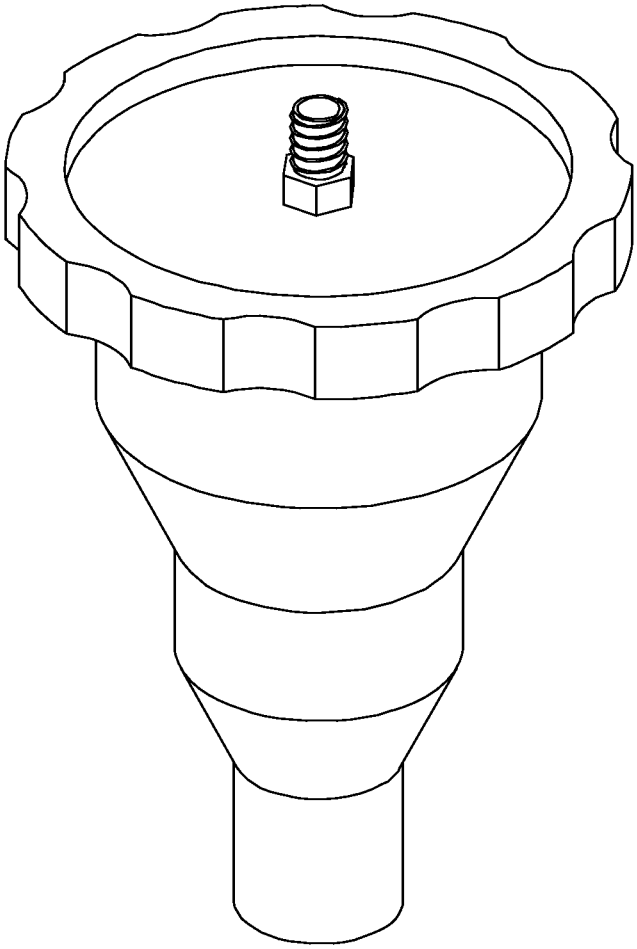
FIG. 4 is an exemplary embodiment of the salt chamber used to produce the quantity of saltwater solution.

In order to produce the quantity of saltwater solution and with reference to FIGS. 3 and 4, the system of the present invention may further include a salt chamber, a filter, a quantity of salt, and a quantity of water. The salt chamber includes a water inlet and a saltwater outlet. The salt chamber is filled with the quantity of salt, and the filter is connected across the saltwater outlet. Additionally, the salt chamber can be filled with the quantity of sodium bicarbonate in order adjust the pH level before the quantity of saltwater solution is added into the electrolytic cell. The salt chamber is a container designed to speed up the rate of dissolving salt crystals. The filter prevents any undissolved salt crystals from exiting out of the saltwater outlet. The quantity of saltwater solution is produced by flowing the quantity of water into the water inlet, through the quantity of salt, through the filter, and out of the saltwater outlet. As the quantity of water flows through the salt chamber, the quantity of salt is dissolved quickly due to the design of the salt chamber. Thus, the quantity of saltwater solution is produced, which is thoroughly diluted. As mentioned, the salt chamber is designed to speed up the rate of dissolving salt crystals. Thus, the salt chamber includes a lateral chamber body, and the lateral chamber body is shaped with a tiered taper from the water inlet to the saltwater outlet. The tiered taper from the water inlet to the saltwater outlet causes the quantity of water to flow faster from the water inlet to the saltwater outlet.

Figure 5:
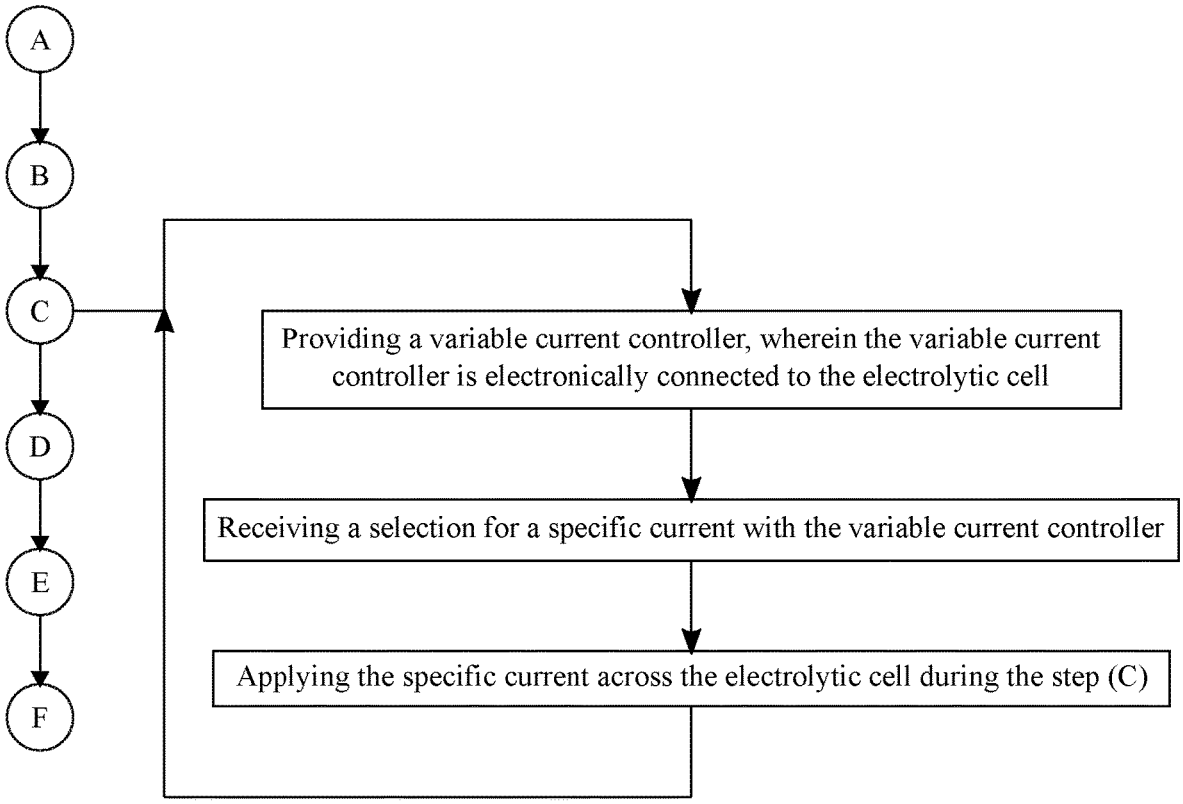
FIG. 5 is a flowchart illustrating the subprocess of using a variable current controller to manage the current produced by the electrolytic cell.
Figure 10:
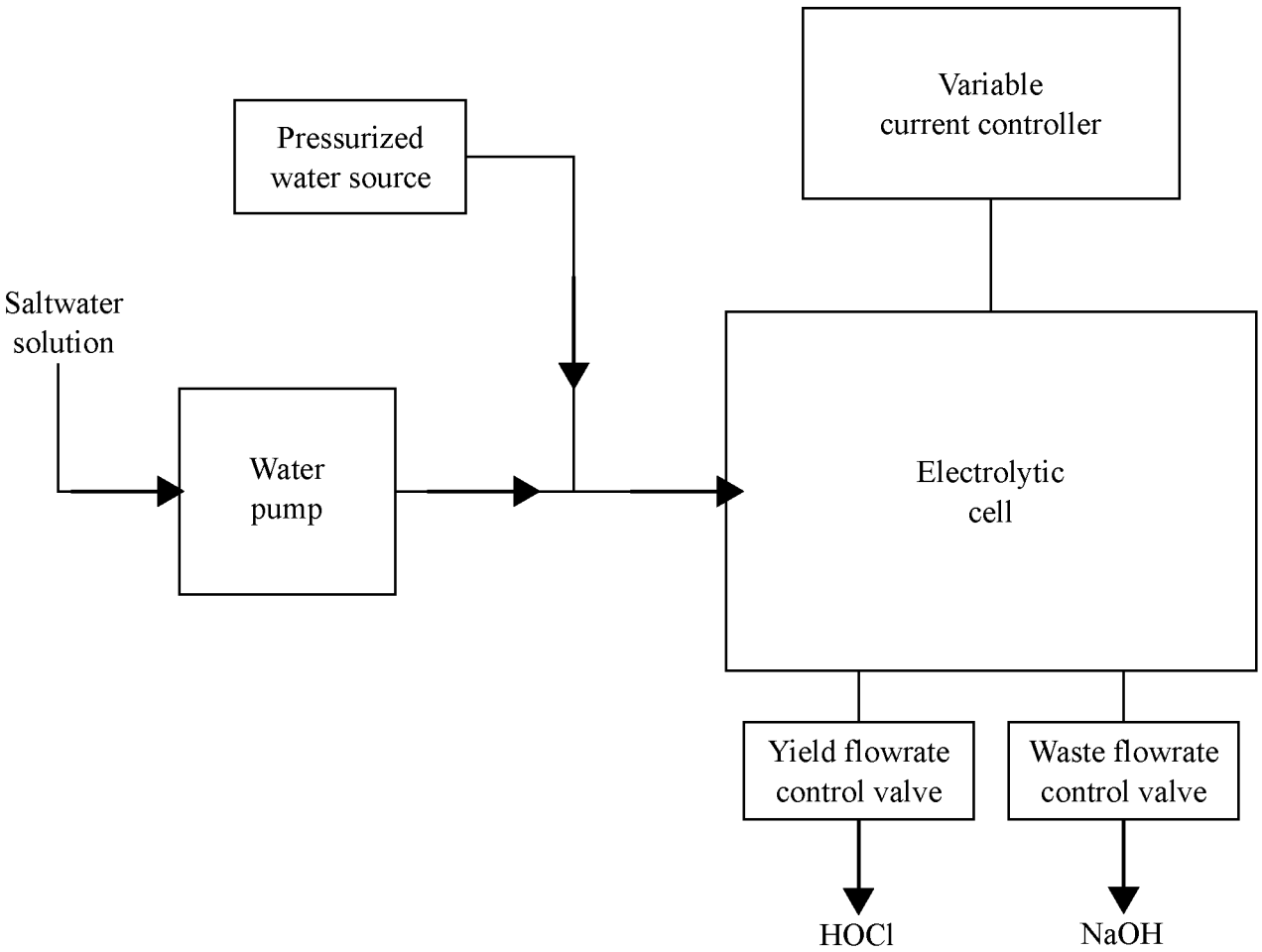
FIG. 10 is a diagram displaying the system of the present invention with the water pump, the pressurized water source, the variable current controller, the waste flowrate control valve, and the yield flowrate control valve.

In order to control and manage the amount of current outputted during the electrolysis process and with reference to FIGS. 5 and 10, the present invention may further comprise a variable current controller. The variable current controller is electronically connected to the electrolytic cell through wiring. A selection for a specific current is received with the variable current controller. In further detail, a user can input an amount of current that is outputted by the electrolytic cell. The specific current is then applied across the electrolytic cell during Step C. Thus, a user can control and manage the amount of current outputted during the electrolysis process.

Figure 6:
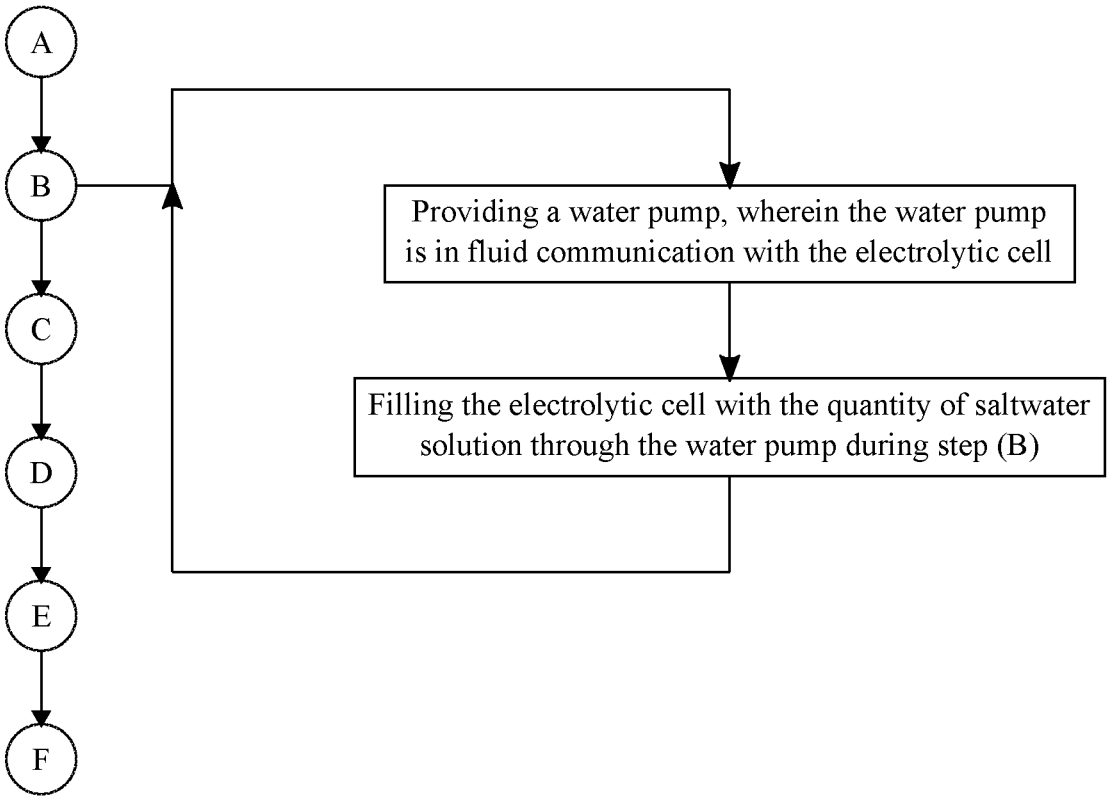
FIG. 6 is a flowchart illustrating the subprocess of using a water pump to fill the electrolytic cell with the quantity of saltwater solution.

In order for the quantity of saltwater solution to be continuously electrolyzed as it flows into the electrolytic cell and with reference to FIGS. 6 and 10, the present invention may further comprise a water pump. The water pump is in fluid communication with the electrolytic cell. The fluid communication between the water pump and the electrolytic cell can be established through a set of pipes. The electrolytic cell is filled with the quantity of saltwater solution through the water pump during Step B. In further detail, the water pump speeds up how fast the quantity of saltwater solution flows into the electrolytic cell. Thus, the quantity of saltwater solution is continuously electrolyzed as the quantity of saltwater solution flows into the electrolytic cell.

Figure 7:
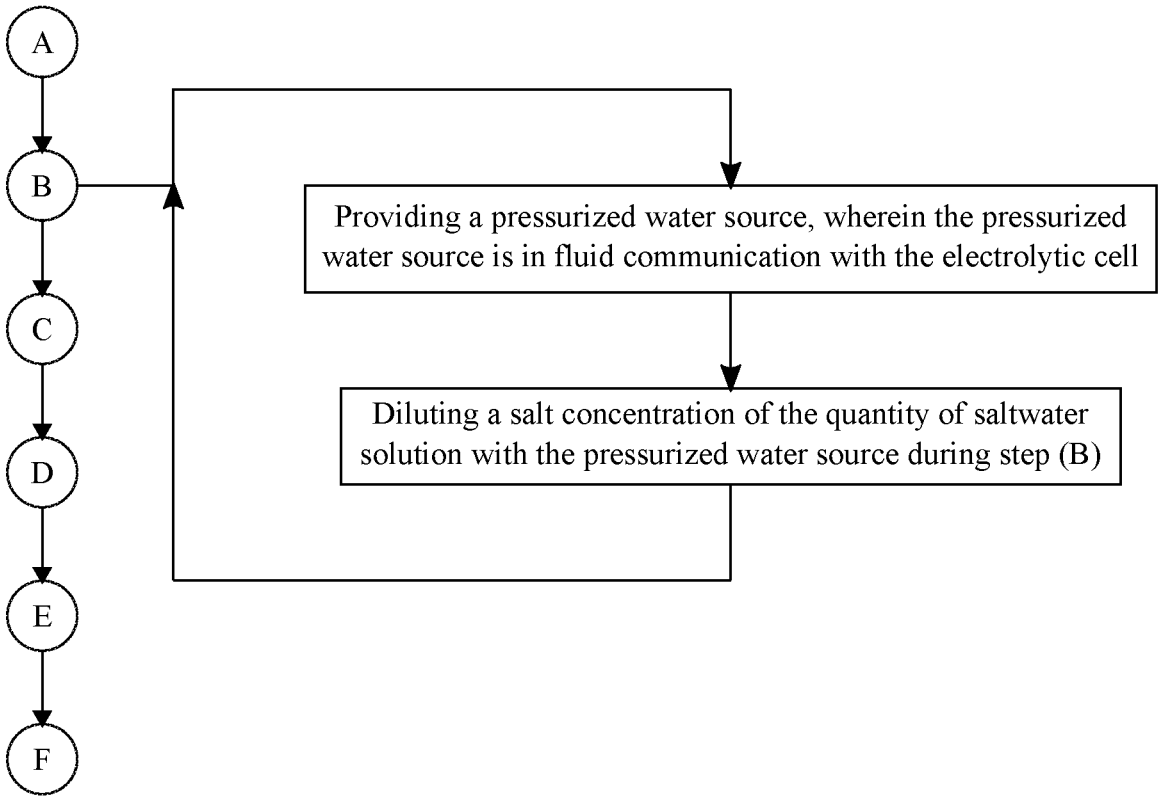
FIG. 7 is a flowchart illustrating the subprocess for further diluting the salt concentration of the saltwater solution.

In order to further dilute the quantity of saltwater solution as it flows into the electrolytic cell and with reference to FIGS. 7 and 10, the present invention may further comprise a pressurized water source. The pressurized water source is in fluid communication with the electrolytic cell. The fluid communication between the pressurized water source and the electrolytic cell can be established through a set of pipes. A salt concentration of the quantity of saltwater solution is diluted with the pressured water source during Step B. In further detail, an additional quantity of water from the pressurized water source mixes with the quantity of saltwater solution as the quantity of saltwater solution flows into the electrolytic cell. Thus, the quantity of saltwater solution is further diluted as it flows into the electrolytic cell.

Figure 8:
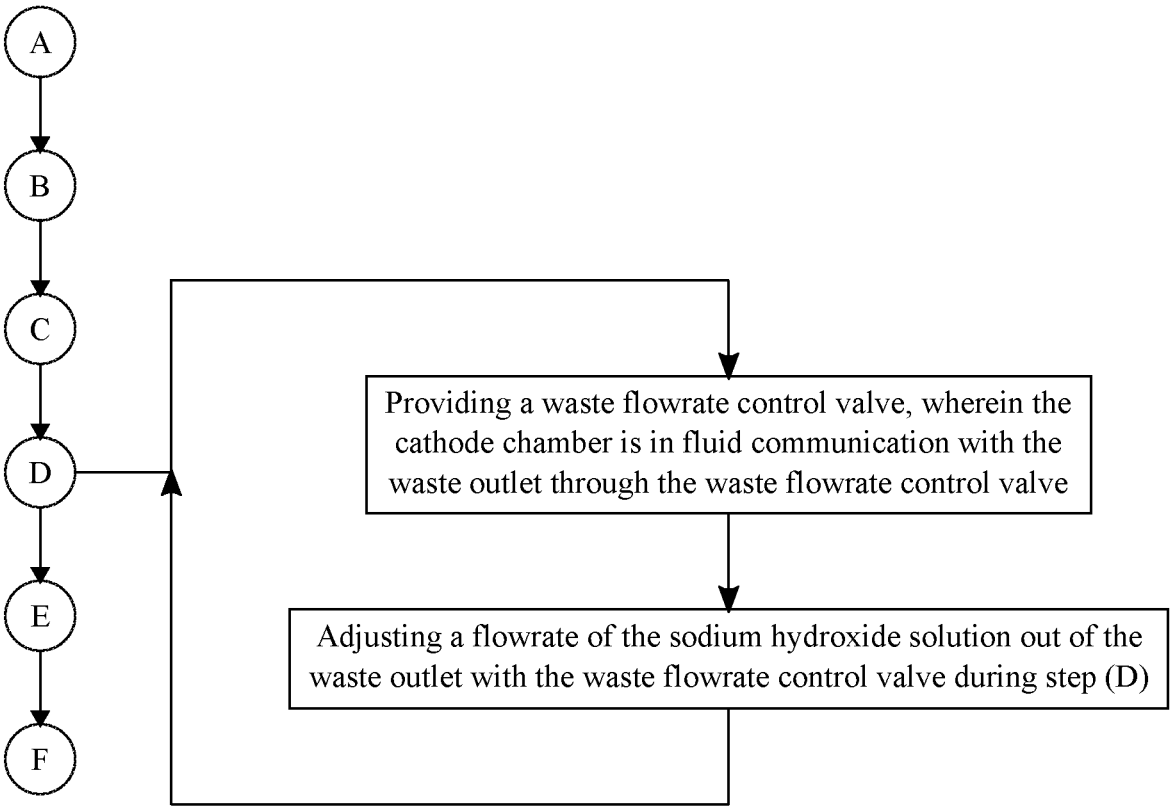
FIG. 8 is a flowchart illustrating the subprocess for adjusting the flowrate of the sodium hydroxide solution exiting out of the waste outlet.

In order to control the flowrate of the sodium hydroxide solution exiting the waste outlet and with reference to FIGS. 8 and 10, the present invention may further comprise a waste flowrate control valve. The cathode chamber is in fluid communication with the waste outlet through the waste flowrate control valve. The flowrate of the sodium hydroxide solution out of the waste outlet is adjusted with the waste flowrate control valve during Step D. Thus, a user can control how fast and how much of the sodium hydroxide solution flows out of the waste outlet.

Figure 9:
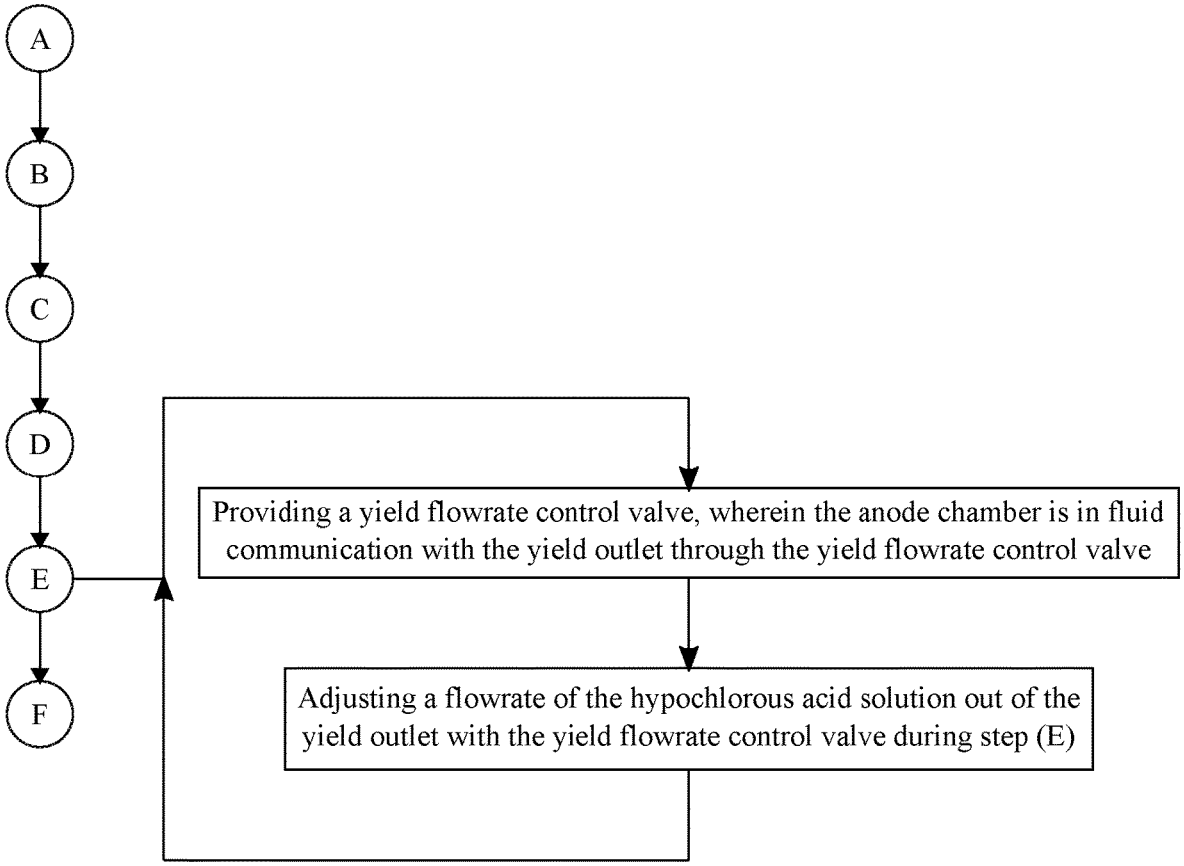
FIG. 9 is a flowchart illustrating the subprocess for adjusting the flowrate of the hypochlorous acid solution exiting out of the yield outlet.

In order to control the flowrate of the hypochlorous acid solution exiting the yield outlet and with reference to FIGS. 9 and 10, the present invention may further comprise a yield flowrate control valve. The anode chamber is in fluid communication with the yield outlet through the yield flowrate control valve. The flowrate of the hypochlorous acid solution out of the yield outlet is adjusted with the yield flowrate control valve during Step E. Thus, a user can control how fast and how much of the hypochlorous acid solution flows out of the yield outlet.

Although the invention has been explained in relation to its preferred embodiment, it is to be understood that many other possible modifications and variations can be made without departing from the spirit and scope of the invention as hereinafter claimed.

What is claimed is:

1. A method for making hypochlorous acid using saltwater with sodium bicarbonate, the method comprising the steps of:

(A) providing an electrolytic cell, a quantity of saltwater solution, and a quantity of sodium bicarbonate, wherein the electrolytic cell includes at least one solution inlet, a waste outlet, a yield outlet, a cathode chamber, an anode chamber, and a semipermeable membrane, and wherein the solution inlet is in fluid communication with the anode chamber and the cathode chamber, and wherein the anode chamber and the cathode chamber are in osmotic communication with each other through the semipermeable membrane, and wherein the anode chamber is in fluid communication with the yield outlet, and wherein the cathode chamber is in fluid communication with the waste outlet;

(B) filling the electrolytic cell with the quantity of saltwater solution through the solution inlet, wherein sodium bicarbonate is added into the quantity of saltwater solution prior to filling the electrolytic cell;

(C) executing an electrolysis process on the quantity of saltwater solution with the electrolytic cell;

(D) chemically separating a quantity of sodium cations from the anode chamber, through the semipermeable membrane, into the cathode chamber, and out of the waste outlet, wherein the quantity of sodium cations combines with hydroxide in the cathode chamber in order to exit out of the waste outlet as a sodium hydroxide solution;

(E) chemically separating a quantity of chloride anions from the cathode chamber, through the semipermeable membrane, into the anode chamber, and out of the yield outlet, wherein the quantity of chloride anions combines with carbonic acid in the anode chamber in order to exit out of the yield outlet as a hypochlorous acid solution and carbon dioxide gas, wherein the carbonic acid in the anode chamber is formed from the sodium bicarbonate added into the quantity of saltwater solution prior to filling the electrolytic cell;

(F) adjusting the hypochlorous acid solution to a desired pH level by adding the quantity of sodium bicarbonate to the quantity of saltwater solution during either step (B) or to the hypochlorous acid solution after step (E).

2. The method for making hypochlorous acid using saltwater with sodium bicarbonate as claimed in claim 1, the method comprising the steps of:

providing a salt chamber, a filter, a quantity of salt, and a quantity of water, wherein the salt chamber includes a water inlet and a saltwater outlet, and wherein the salt chamber is filled with the quantity of salt, and the filter is connected across the saltwater outlet; and producing the quantity of saltwater solution by flowing the quantity of water into the water inlet, through the quantity of salt, through the filter, and out of the saltwater outlet.

3. The method for making hypochlorous acid using saltwater with sodium bicarbonate as claimed in claim 2, wherein the salt chamber is filled with the quantity of sodium bicarbonate, and wherein the quantity of sodium bicarbonate is the sodium bicarbonate added into the quantity of saltwater solution prior to filling the electrolytic cell.

4. The method for making hypochlorous acid using saltwater with sodium bicarbonate as claimed in claim 2, wherein the salt chamber further includes a lateral chamber body, and wherein the lateral chamber body is shaped with a tiered taper from the water inlet to the saltwater outlet.

5. The method for making hypochlorous acid using saltwater with sodium bicarbonate as claimed in claim 1, the method comprising the steps of:

providing a variable current controller, wherein the variable current controller is electronically connected to the electrolytic cell;

receiving a selection for a specific current with the variable current controller; and applying the specific current across the electrolytic cell during the step (C).

6. The method for making hypochlorous acid using saltwater with sodium bicarbonate as claimed in claim 1, the method comprising the steps of:

providing a water pump, wherein the water pump is in fluid communication with the electrolytic cell; and filling the electrolytic cell with the quantity of saltwater solution through the water pump during step (B).

7. The method for making hypochlorous acid using saltwater with sodium bicarbonate as claimed in claim 1, the method comprising the steps of:

providing a pressurized water source, wherein the pressurized water source is in fluid communication with the electrolytic cell; and diluting a salt concentration of the quantity of saltwater solution with the pressurized water source during step (B).

8. The method for making hypochlorous acid using saltwater with sodium bicarbonate as claimed in claim 1, the method comprising the steps of:

providing a waste flowrate control valve, wherein the cathode chamber is in fluid communication with the waste outlet through the waste flowrate control valve; and adjusting a flowrate of the sodium hydroxide solution out of the waste outlet with the waste flowrate control valve during step (D).

9. The method for making hypochlorous acid using saltwater with sodium bicarbonate as claimed in claim 1, the method comprising the steps of:

providing a yield flowrate control valve, wherein the anode chamber is in fluid communication with the yield outlet through the yield flowrate control valve; and adjusting a flowrate of the hypochlorous acid solution out of the yield outlet with the yield flowrate control valve during step (E).

10. The method for making hypochlorous acid using saltwater with sodium bicarbonate as claimed in claim 1, wherein the quantity of saltwater solution includes a salt selected from the group consisting of: sodium chloride, potassium chloride, and sodium hypochlorite.

* * * * *